United States Patent [19]

Nelson

[11] 4,073,119

[45] Feb. 14, 1978

[54] TAPING APPARATUS

[75] Inventor: Iver L. Nelson, Minneapolis, Minn.

[73] Assignee: Champion International Corporation, Stamford, Conn.

[21] Appl. No.: 682,529

[22] Filed: May 3, 1976

[51] Int. Cl.[2] ..... B65B 57/16

[52] U.S. Cl. ..... 53/76; 53/137; 93/36.9; 156/522

[58] Field of Search ..... 53/137, 207, 76; 93/36.9; 156/522

[56] References Cited

U.S. PATENT DOCUMENTS

| | | | |
|---|---|---|---|
| 1,298,637 | 4/1919 | Armstrong | 53/137 |
| 1,978,035 | 10/1934 | Thom | 53/137 X |
| 2,649,221 | 8/1953 | Wagner et al. | 53/137 X |
| 3,332,207 | 7/1967 | Midnight | 53/207 X |
| 3,374,603 | 3/1968 | Miller et al. | 53/137 X |
| 3,530,640 | 9/1970 | Hoffmann | 53/207 |

*Primary Examiner*—Othell M. Simpson

*Assistant Examiner*—John Sipos

*Attorney, Agent, or Firm*—Evelyn M. Sommer

[57] ABSTRACT

Apparatus for automatically applying tape to effect the closing of a carton, such tape to be placed not only across the top surface but also continuously down each end of the carton. The apparatus includes means for advancing the containers with the top flaps in folded position into an initial station where the leading end has applied to it one end of a length of tape and where the end flaps and tape are pressed into position by downwardly extending rollers. The rollers are then retracted and the carbon is moved under a tape supply which tapes the top of the carbon and moves the carton into a second station at which point a mechanism cuts the trailing edge of the tape to size and the carton is moved upwardly into a stacking chute having side rails which engage the taped ends of the carton insuring that they are folded into position and holding them in position while the adhesive has time to set.

1 Claim, 8 Drawing Figures

TAPING APPARATUS

BACKGROUND OF THE INVENTION

Field of the Invention

This invention relates to apparatus for automatically applying tape to a partially erected and filled container and includes means for advancing the container into and out of a station at which the adhesive tape is applied and the final folding steps of the carton occur with further means to fold the flaps and tape in position until the adhesive can set.

Description of the Prior Art

There are many devices available for placing adhesive tape of the selfsticking or wetted gum tape variety to the tops of containers where the only folded flaps which are to be sealed meet in the center on the top of the container. The particular style of carton which is designated a top taping opener with outer end closure flaps which are attached to the ends of the top flaps require tape which extends along the top seam and down over the ends to hold these flaps in position. Although most assembly of such cartons is done by hand, there is a need for automated equipment which will apply tape to assist in closing such a carton and be adapted for wetted gum tape as well as contact adhesive tape.

SUMMARY OF THE INVENTION

Equipment for taping a carton where the cartons are presented sequentially to an adhesive tape dispenser which has a predetermined length of tape available to be applied first to the leading end of the carton by wheels which move down to fold the end flaps into position and the tape into contact therewith, the wheels then retracting while the container is moved beneath the tape dispenser along the length of its top seam and beyond a predetermined distance at which point the trailing tape is cut and the carton is then moved upwardly into a chute which holds the end flaps and tape in position while the adhesive sets.

DETAILED DESCRIPTION OF THE PREFERRED EMBODIMENT

Figure 1:
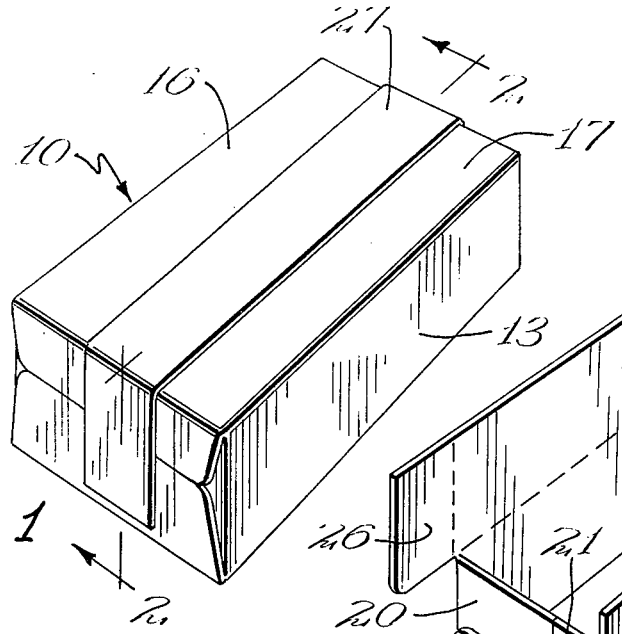
FIG. 1 shows a perspective view of an assembled tape carton of the variety which is to be closed by the apparatus described below.
Figure 3:
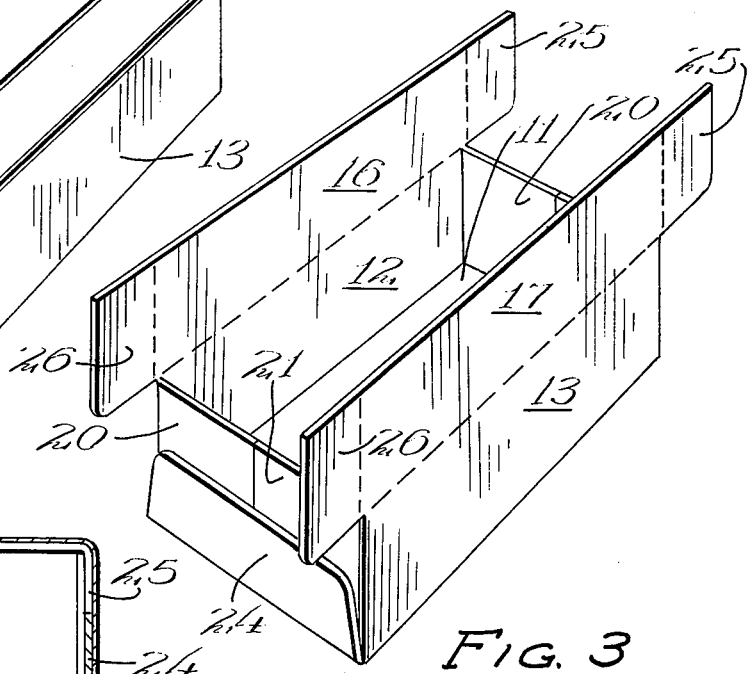
FIG. 3 is a perspective view of the carton in FIG. 1 prior to closing and partly assembled as it would be loaded with merchandise prior to closing in the equipment described below.
Figure 2:
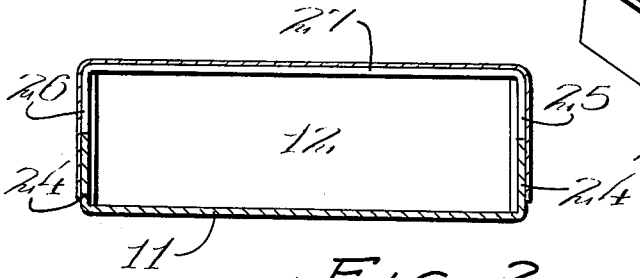
FIG. 2 is a side elevation view in section of the carton shown in FIG. 1 taken along the longitudinal section line 2—2.
Figure 4:
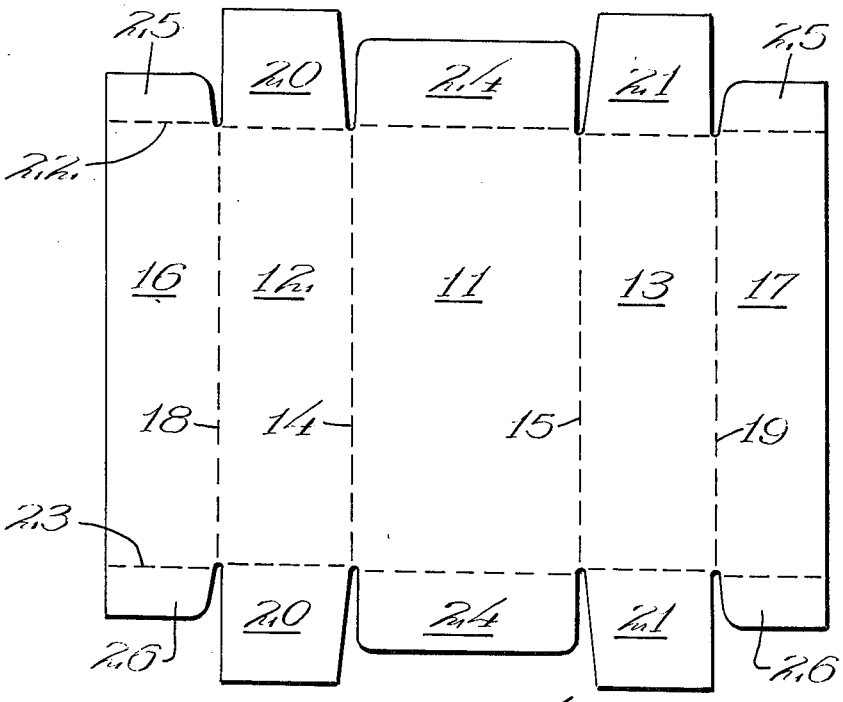
FIG. 4 is a plan view of a blank adapted to be erected into the carton shown in FIGS. 1, 2 and 3.

The automatic or semi-automatic taping of cartons which have conventional flap configurations with two outside flaps which meet in the center of the carton is a conventional and well established area. Some situations require a carton with downwardly extending tabs on the end of these flaps which means that a simple application of adhesive tape will not hold the tabs in position while the adhesive sets. FIGS. 1 through 4 illustrate a container 10 and blank for making same of the variety which is particularly adapted to be erected on this equipment. FIG. 4 shows that the container 10 includes a large bottom panel 11 with side walls 12 and 13 connected along parallel fold lines 14 and 15. The cover is formed by the two halves 16 and 17 attached to the top edges of the side walls 12 and 13 along the folded lines 18 and 19. The ends of the carton are formed by first folding end flaps 20 and 21 which are attached along the ends of the side walls by the parallel fold lines 22 and 23 which define the ends of the carton and the edges of the blank shown in FIG. 4. These are held in position during the loading process by an upwardly extending flap 24 which is attached to each end of the bottom panel 11 along the fold lines 22 and 23. The top flaps 17 and 18 have attached to the ends thereof partial end tabs 25 and 26, respectively. These tabs must be held down against the side of the container while it is being assembled and covered and glued after it is filled. These tabs must be kept in place during the setting period of the adhesive. When such a package 10B is introduced into the system the apparatus is activated.

Figure 5:
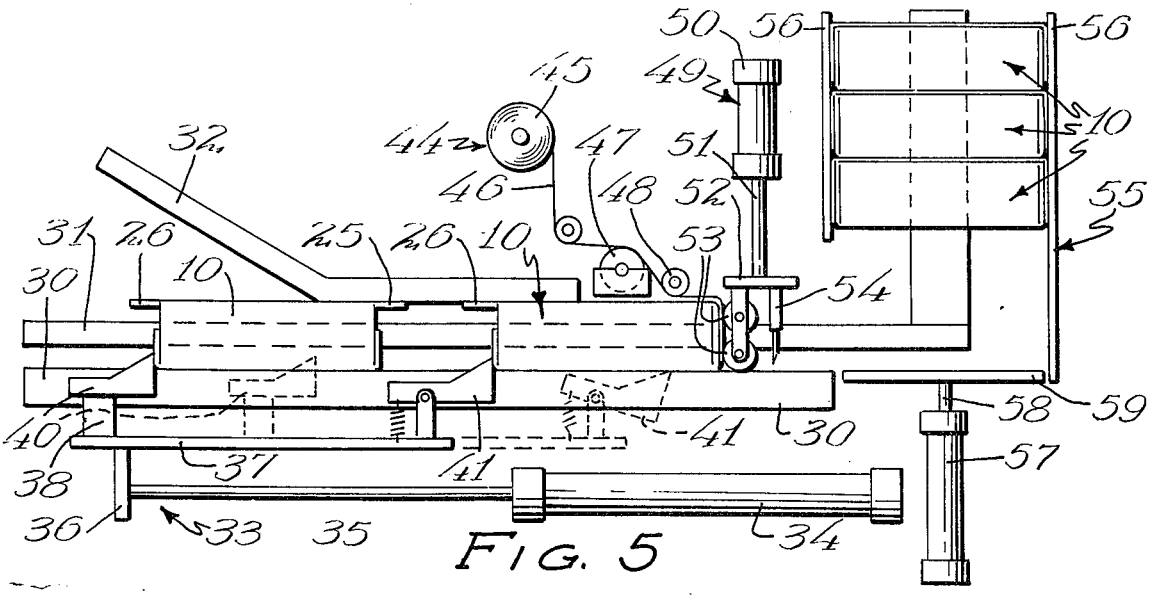
FIG. 5 is a side view of apparatus embodying the present invention illustrating the positioning of the various elements of the apparatus at the beginning of the taping sequence, with a container having been placed in position so that the taping sequence is initiated.

Package 10B, as shown in FIG. 5, is disposed between a pair of parallel rails 31 on a support surface 30. Package 10B is manually fed onto surface 30 between an upper converging guide plate 32 and a push block 40 adjacent one side of support surface 30. Block 40 is mounted on a support standard 38 fixed to one end of a reciprocable plate 37 of a reciprocating feed carriage generally designated by the numeral 33, and is designed to make substantial contact with the trailing end of package 10B which overhangs one side of support surface 30 between rails 31. Reciprocable plate 37 has an integral depending plate 36 fixed to one end of a piston 35 of an air cylinder 34. Mounted on the opposite end of reciprocable plate 37 is a second push block 41. Push block 41 is pivotably mounted by a pin 42 to a standard 39 fixed to plate 37. A coil spring 43 connected between block 41 and plate 37 normally retains the push block 41 in a horizontal attitude as shown in FIGS. 5 and 6.

Figure 8:
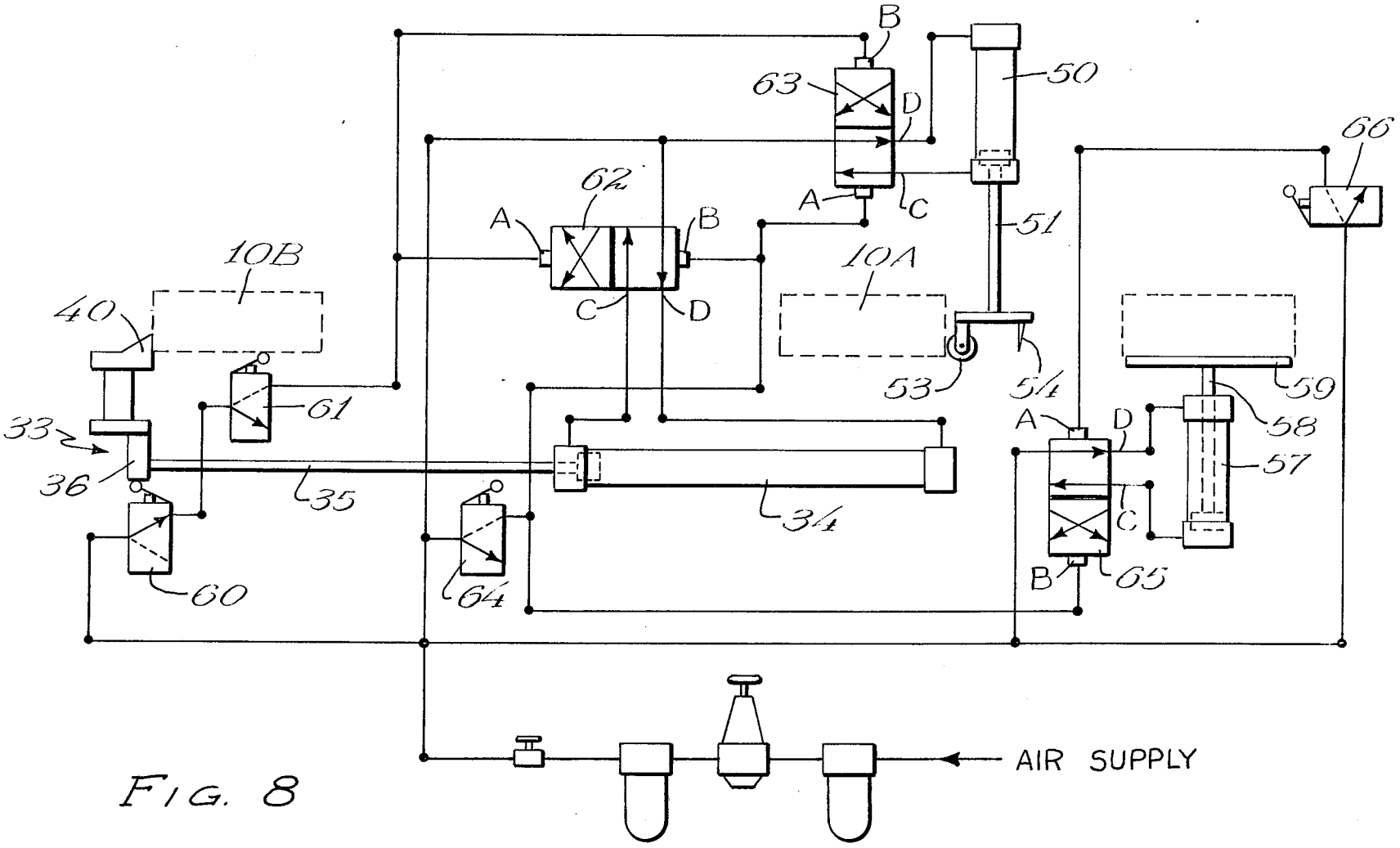
FIG. 8 is a schemtic diagram of a fluid control system for the apparatus shown above.

As shown in FIG. 8, when package 10B is seated on support surface 30 between rails 31 in contact with push block 40, and piston 35 is fully extended, switches are activated to open a pair of air valves 60 and 61 connected in series to a supply of compressed air. Air is then directed from the source through valves 60 ad 61 to the inlet port A of a fourway pilot valve 62, which causes the valve 62 to shift so that air from the source enters cylinder 34 through port C and exhausts through port D, retracting piston 35. Retraction of piston 35, as shown in phantom lines in FIG. 5, causes push block 40 to slide package 10B to a tape applying station 44. Simultaneously, a previously taped package 10A located at the tape applying station 44 is slid by push block 41 (as will be described hereinafter) onto an elevator platform 59. Upon extension of piston 35 on the reciprocable stroke of cylinder 34, the front end of push block 41 pivots downwardly about pin 42 passing beneath package 10B. When push block 41 clears the trailing end of package 10B, spring 43 returns it to its horizontal attitude in abutment with the trailing end of package 10B.

As push blocks 40 and 41 are moved forwardly upon retraction of piston 35, air is supplied from the source through valves 60 and 61 to the inlet port B of a four-way pilot valve 63, shifting the valve to allow air to enter an air cylinder 50 to retract its piston 51. Air is bled from the cylinder 50 through port D of valve 63. Cylinder 50 and piston 51 are part of a pressure roller and knife assembly 49; the piston 51 being fixed to a plate 52 having a downwardly extending cutting knife 54 and a pair of spaced rollers 53 rotatably mounted on its lower surface. Retraction of piston 51 permits package 10A to be disposed on elevator platform 59, without interference.

Figure 6:
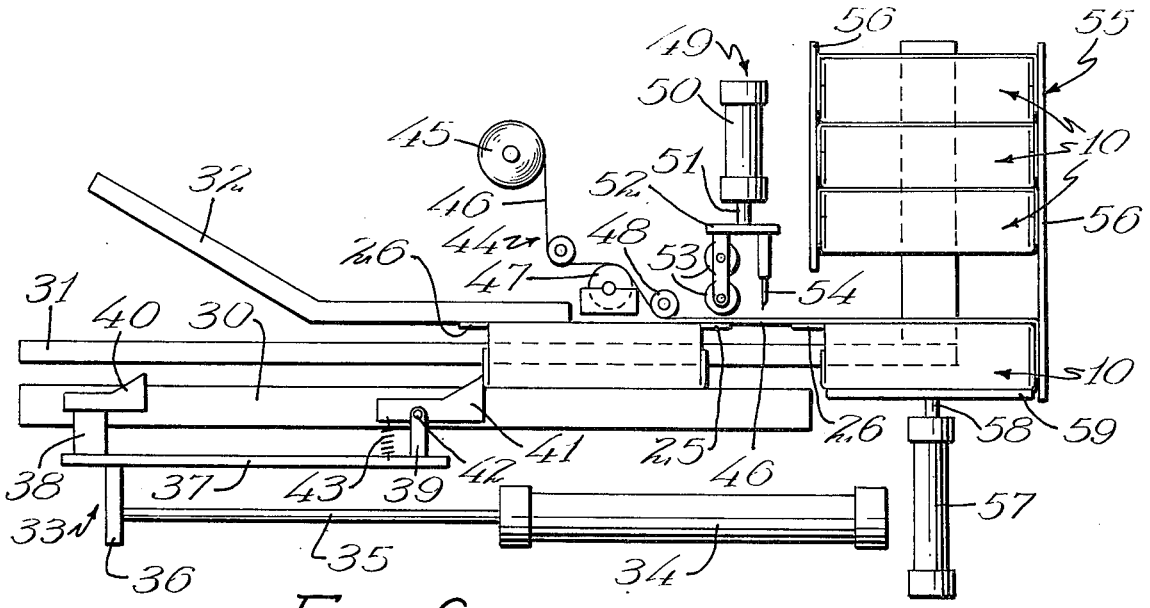
FIG. 6 illustrates the mechanism of FIG. 5 with the two cartons having been advanced and shows the tape just prior to being severed with the carriage having already recycled to the initial position.
Figure 7:
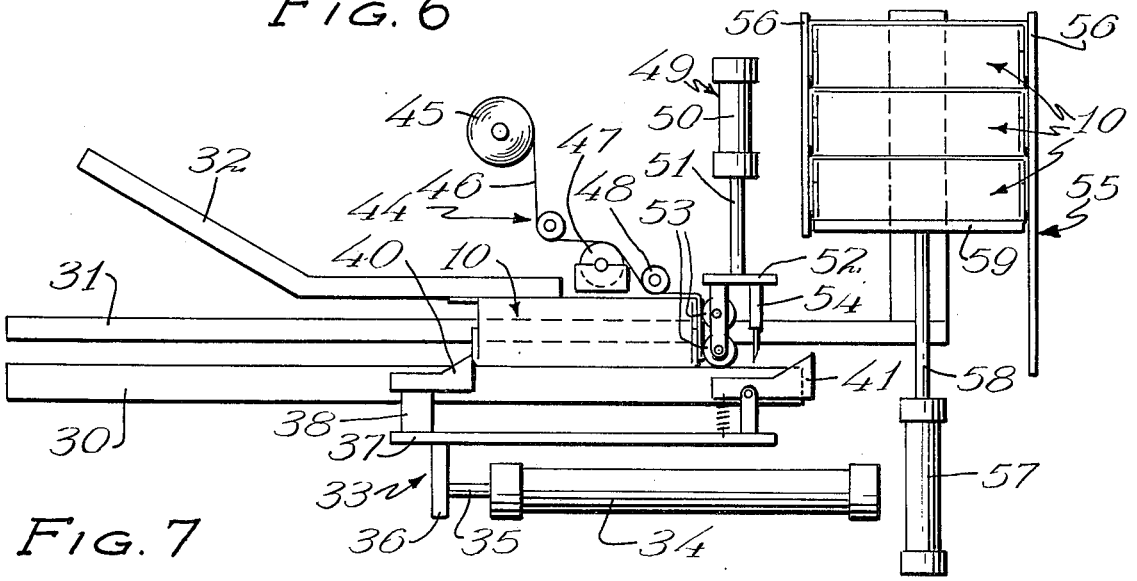
FIG. 7 is a side elevation view of the apparatus in FIG. 5 showing the tape having been severed and pressed into position on the container in the tape station, with the container leaving the station having been pushed up into the chute where it is held in position while the tape sets.

As package 10B arrives at the tape applying station 44, tape 46, having a gummed adhesive surface, wound in a roll 45 and threaded between guide rollers 48 over a wheel 47 rotatably disposed in a water trough for wetting the gummed surface, is pulled from roll 45 over wheel 47 by the trailing end tab 26 of package 10A disposed on platform 59 over the leading end tab 25 of package 10B, causing a length of tape to be disposed between packages 10A and 10B, as shown in FIG. 6. At this point, plate 36 closes the switch of air valve 64, permitting air to be disposed through valve 64 to the inlet ports of B and A, respectively, of fourway pilot valves 62 and 63, causing cylinders 34 and 50 to extend pistons 35 and 51, respectively, returning push blocks 40 and 41 to the position indicated in FIGS. 6 and 7, and to lower rollers 53 and knife 54 to the position indicated in FIG. 7. Simultaneously, air is admitted through valve 64 to the inlet B of a fourway pilot valve 65 causing the valve to shift to connect port C of valve 65 to the source of air, admitting air to the interior of an air cylinder 57 to extend its piston 58 connected to elevator platform 59 and raise platform 59.

The platform 59 raises package 10A into frictional engagement between the side walls 55 of a chute 56. The walls 55 frictionally engage the end flaps 25 and 26 of carton 10A and ungummed surfaces of tape 46 causing the gummed surfaces to firmly adhere to the tabs, ends and top of package 10A. Of course, the tape 46 between cartons 10A and 10B is simultaneously cut by knife 54 on extension of piston 51 and the rollers 53 press and adhere one end of the cut tape to the end tab 25 and leading edge of carton 10B. As the piston 51 reaches its lowermost extended position, the switch of a valve 66 is closed allowing air from the source to be directed to inlet port A of valve 65, shifting the valve to enable air to be supplied through port D to retract piston 57.

The apparatus is then ready to recycle with the insertion of a new package 10B between rails 30.

I claim:

1. Apparatus for applying tape to the top and ends of a carton of the type having abutting top closure flaps where the tape is located longitudinally to cover the abutting edges of said top closure flaps, and said top closure flaps have end tabs connected to the ends thereof which are folded downwardly to cover at least a portion of the end of said carton such that the tape must extend down the end of the carton to hold said tabs in position, said apparatus being operable sequentially and automatically on successive cartons as they are placed on said apparatus, said apparatus comprising:

rail means on which said cartons may be located at a load station and on which said cartons may be advanced in spaced apart pairs to their longitudinal axis;

reciprocating feed carriage means for engaging each of said cartons when placed on said rail means at said load station and advancing it into position beneath means for dispensing tape continuously and horizontally as said carton moves beneath said tape dispensing means, said tape dispensing means pressing said tape into position to cover a portion of the longitudinally extending abutting edges of said top cover flaps;

said feed carriage means also engagable with each of said cartons positioned beneath said tape dispensing means to advance each of said cartons along said rail means away from said tape dispensing means to a predetermined position leaving a length of tape extending between adjacent cartons;

vertically retractable means for cutting said tape between adjacent cartons being moved through said apparatus, said vertically retractable means also including pressing means for holding that portion of said tape covering the leading end of each of said carton in said tape dispending means down into position; said cutting means biased downwardly to hold said tabs in position on the leading end of a carton which is stationary beneath said dispensing means;

control means for sensing a carton introduced at said load station and activating said carriage means to advance said carton beneath said dispensing means, said control means coacting to retract said cutting means to allow the carton beneath said dispensing means to be moved by said carriage means along said rail means; and elevator means includng a vertically reciprocating means for supporting a carton after the tape has been applied thereto and, after said tape has been cut, moving it upwardly into a chute which engages the ends of said carton and holds said tape and said end tabs in position to provide time for said tape to adhere to the tabs and ends of said carton.

* * * * *